US005551695A

United States Patent [19]

Wolk

[11] Patent Number: 5,551,695

[45] Date of Patent: Sep. 3, 1996

[54] APPARATUS FOR TRAINING A GOLFER TO PROPERLY PUTT A GOLF BALL

[76] Inventor: Roger S. Wolk, 28 Malibu Colony Dr., Malibu, Calif. 90265

[21] Appl. No.: 284,147

[22] Filed: Aug. 2, 1994

[51] Int. Cl.[6] ..... A63B 69/36

[52] U.S. Cl. ..... 473/236; 473/238; 473/252

[58] Field of Search ..... 273/186.1, 186 C, 273/192, 177 R, 183 R, 191 R, 194 A, 186.2, 163 R, 187.4

[56] References Cited

U.S. PATENT DOCUMENTS 4,323,246 4/1982 Nehrbas, Jr. .
4,437,669 3/1984 Pelz .
5,082,280 1/1992 Wang .
5,135,229 8/1992 Archer ..... 273/186.2
5,150,904 9/1992 Sindelar .
5,246,233 9/1993 Sheltman et al. .
5,351,961 11/1994 Eulau ..... 273/186.2

*Primary Examiner*—V. Millin
*Assistant Examiner*—Charles W. Anderson
*Attorney, Agent, or Firm*—Thomas I. Rozsa; Tony D. Chen

[57] ABSTRACT

The present invention apparatus is a golf putting training device for training a golfer to properly putt a golf ball in a training environment. Training apparatus comprises two elongated telescoping guide members each having an outer guide and an inner guide, the guide members are removably affixed to the head portion of the golf putter.

7 Claims, 4 Drawing Sheets

APPARATUS FOR TRAINING A GOLFER TO PROPERLY PUTT A GOLF BALL

BACKGROUND OF THE INVENTION

1. Field of the Invention

The present invention relates to the field of golf accessories. More particularly, the present invention relates to the field of golf training devices which include a special putting surface for training a golfer to properly putt a golf ball.

2. Description of the Prior Art

Generally, there are many golf training devices which have been developed over the years for improving a golf player's putting game. One of the prior art devices is a putting training track for practicing the putting stroke by rolling a golf ball along an upward sloping surface of the track. The disadvantage with the prior art putting training track is that the device has a fixed orientation and cannot be optionally adjusted for varying a sloping angle and the distance from the cup hole on the track.

Another prior art device is a putter which has two notches for two tees which are used as alignment markers when they are placed on the putter to facilitate striking of the golf ball on a true line towards the cup hole. The disadvantage with this device is that the notches on the putter are at a fixed position and the tees cannot be adjusted in the transverse direction. These alignment markers are designed to be slightly greater than the diameter of the golf ball and by doing this, the golfer who is practicing his or her putting stroke is forced into a position where he or she has to hit the golf ball exactly between the two alignment markers on the "sweet spot" portion of the putter. When the golf ball is improperly stroked, it strikes one of the alignment markers and is deflected away from the target.

The following six (6) prior art patents were uncovered in the pertinent field of the present invention.

1. U.S. Pat. No. 4,323,246 issued to Nehrbas, Jr. on Apr. 6, 1982 for "Golf Practice Putting Aid" (hereafter "the Nehrbas Patent").
2. U.S. Pat. No. 4,437,669 issued to Pelz on Mar. 20, 1984 for "Golf Practice Putting Track" (hereafter "the Pelz Patent").
3. U.S. Pat. No. 5,082,280 issued to Wang on Jan. 21, 1992 for "Putting Practice Device" (hereafter "the Wang Patent").
4. U.S. Pat. No. 5,135,229 issued to Archer on Aug. 4, 1992 for "Golf Putter With Training Device" (hereafter "the Archer Patent").
5. U.S. Pat. No. 5,150,904 issued to Sindelar on Sep. 29, 1992 for "Golf Putting Training Device" (hereafter "the Sindelar Patent").
6. U.S. Pat. No. 5,246,233 issued to Sheltman et al. on Sep. 21, 1993 for "Device For Putting Training" (hereafter "the Sheltman Patent").

The Nehrbas Patent discloses a golf practice putting aid. It includes a pressure sensitive adhesive backing for removably attaching the aid to the striking face of a conventional putter. The golf putting aid has a transversely extending backing member with front and rear surfaces. A pair of upright spaced parallel rails extend outward from the front surface at the transverse limits of the backing member.

The Pelz Patent discloses a golf putting stroke practice track contoured to follow the putter head path during a putting stroke. The practice track includes a pair of L-shaped rail sections which are curved or contoured so that their lowest portion is located at or near the point of impact and so that they are gradually raised towards either end from the impact point.

The Wang Patent discloses a golf putting practice device. It includes a sloping board, a slope-adjusting plate, a surface mat and an access plate. An arcuate sloping tunnel transversely formed in the sloping board communicates with a ball hole which arcuately slopes sidewardly and downwardly on the sloping board.

The Archer Patent discloses a golf putter head. It includes a pair of notches which are formed in the top surface of the face plate thereof. These notches receive golf tees in removable retention such that when installed in place on the club head, they form spacers. The distance between the spacers is slightly larger than the diameter of a golf ball such that the ball can fit therebetween and without permitting the ball to strike either tee, thereby perfecting the ability to strike the ball at the optimum point on the face plate.

The Sindelar Patent discloses a golf putting training device. It includes a golf club head with a stabilizer portion which is provided at its heel end and is used in combination with a planar guide surface to practice putting strokes.

The Sheltman Patent discloses an apparatus for training a person to putt a golf ball accurately. It includes a pair of guide rails and a fixing means for removably fixing the rail on a soft surface. A connecting rod has an elongated slot extending linearly over the length of the rod, has an arcuate segment at one end, and includes a series of spaced apart alignment marks. The slot slidably accepts an attaching means of one rail for rotatably and slidably mounting the rail in the slot. A pivotal mounting hole rotatably accepts a sliding attaching means of one guide rail so that the other of the rails may be rotated with respect to the connecting rod.

There is always a need for an improved golf training apparatus which includes an adjustable putting training track and adjustable alignment markers which are attached to a conventional golf putter to better train a golfer to properly putt a golf ball.

SUMMARY OF THE INVENTION

The present invention apparatus is a complete system of an adjustable golf putting training track and a golf putter training device for training a golfer to properly putt a golf ball into a cup hole on the putting training track. The golf putter training device is two elongated telescoping guide members which are removably attached a conventional putter.

It is an object of the present invention to provide an apparatus which includes both an adjustable golf putting training track and a golf putter training device with adjustable guide members for training a golfer to properly putt a golf ball into a cup hole.

It is also an object of the present invention to provide a putting training track which includes a plurality of tracks connected by interlockable connector inserts for increasing the length of the putting training track or shortening the length of the putting training track, such that the track is easily assembled and disassembled.

It is an additional object of the present invention to provide an adjustable golf training track which has means for increasing the slope of each track of the golf training track.

It is a further object of the present invention to provide a golf training track which has a narrow conduit integrally connected to the golf training track for providing air to the cup hole to allow the golf ball to be pump out therefrom and cause the ball to return to its original position by rolling along gutters on both sides of the golf training track.

It is an additional object of the present invention to provide a golf training track which is easily adjustable and adapted for all types of conventional putters.

It is a further object of the present invention to provide a golf training track which includes two opposite parallel rails and includes means for altering the width between the two opposite rails.

It is an additional object of the present invention to provide a golf putter training device for training a golfer to putt properly, in which the device can be readily installed on a conventional putter for training and removed from the putter during actual play.

It is a further object of the present invention to provide a golf putter training device which includes two elongated telescoping guide members extending forwardly on the face of the putter head portion, where the guide members can be easily repositioned for adjusting the width between the guide members. Also, the guide members serve to point to the cup hole to help control the direction of the swing.

In the preferred embodiment of the present invention, the apparatus includes a combination of an adjustable golf putting training track and a golf putter training device with adjustable alignment guide members for training a golfer to properly putt a golf ball into a cup hole on the putting training track.

Described generally, the present invention apparatus is a complete system of a longitudinal elongated putting training track and a golf putter training device. The putting training track includes a plurality of tracks which are connected together by interlockable connector inserts respectively. The interlockable connector inserts are inserted into a slotted T-shaped connection on each track of the putting training track.

The golf putter training device is used in conjunction with a conventional putter. Two elongated telescoping guide members are removably attached to a face plate of the putter and extend away from the putter head portion.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figures 1, 5:
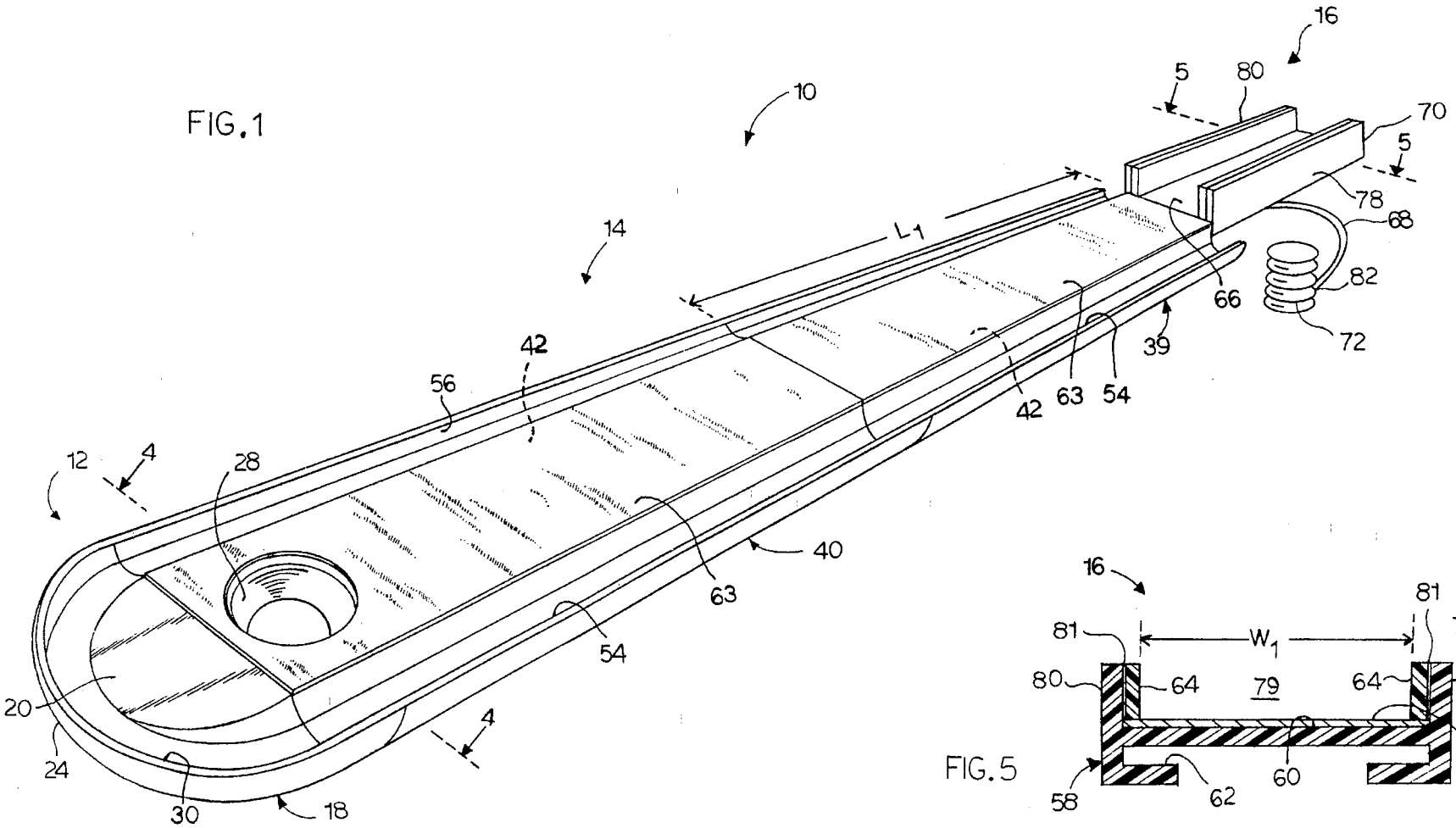
FIG. 1 is a perspective view of the preferred embodiment of the present invention apparatus illustrating a golf putting training track.
FIG. 5 is an enlarged cross-sectional view taken along line 5—5 of FIG. 1.

Referring to FIG. 1, there is shown at 10 a perspective view of a longitudinally elongated golf putting training track. The present invention apparatus is a complete system of the golf putting training track 10 and two telescopic adjustable guide members attached to a conventional golf putter (shown in FIGS. 8 and 9) for training a golfer to properly putt a golf ball into a cup hole 28 on the putting training track 10. The putting training track 10 includes a rear portion 12, a middle portion 14 and a front portion 16.

Figure 3:
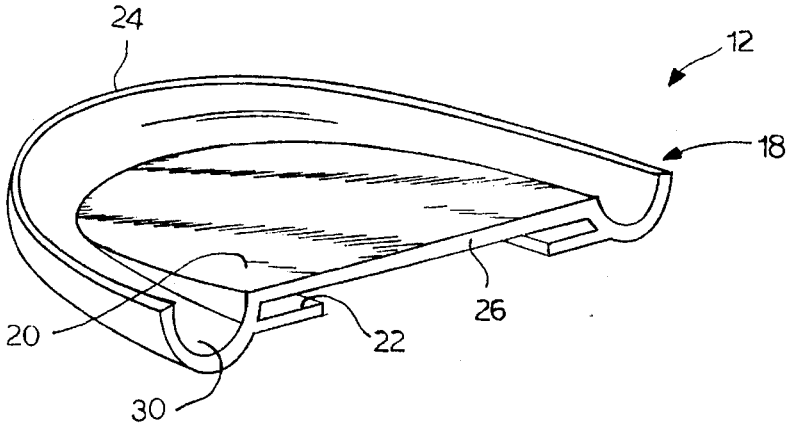
FIG. 3 is a perspective view of a rear portion of the golf putting training track.

Referring to FIGS. 1 and 3, there is shown that the rear portion 12 which includes a rear track 18. The rear track 18 has an upper slanted surface 20, a slotted lower surface 22, a curved distal end 24, a proximal end 26 and an arcuate gutter 30. The arcuate gutter 30 is integrally connected and surrounds the rear track 18 except for the proximal end 26. The upper slanted surface 20 is used for allowing the golf ball to roll down onto the gutter 30 when the golfer misses the cup hole, so that the golf ball can be automatically returned to the golfer via the gutter 30.

Figure 2:
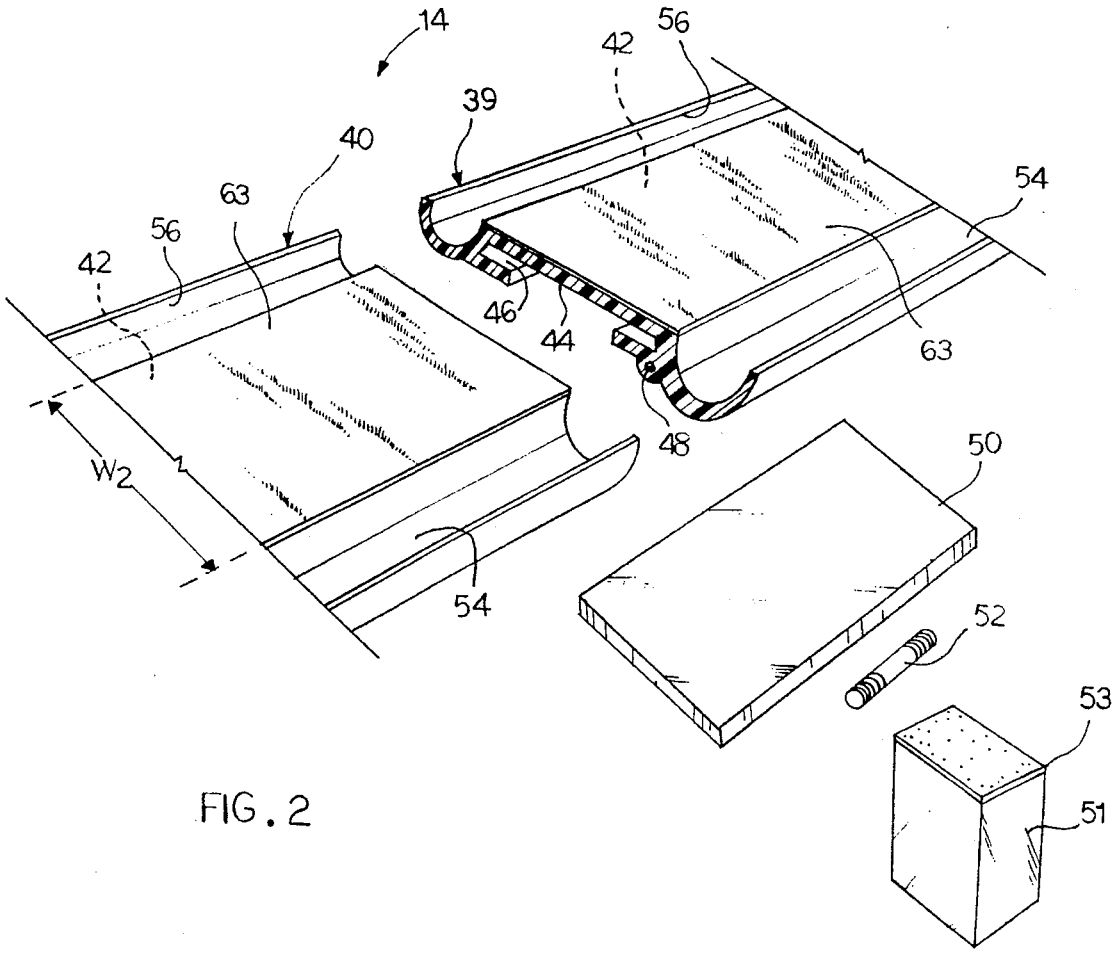
FIG. 2 is a partial exploded perspective view of the present invention illustrating an interlockable connector insert for connecting the tracks, a hollow tube for connecting the conduits, and an elevation block for sloping the golf putting training track.

Referring to FIGS. 1 and 2, the middle portion 14 includes a first track 39 and a second track 40. It will be appreciated that the middle portion 14 can include a plurality of tracks incorporated into the present invention to increase the length of the elongated golf putting training track 10 and for the purpose of clarity, only two tracks are illustrated.

The first and second tracks 39 and 40 are preferably identical in construction with only a slight modification to the second track 40, and only one will be described in great detail. The only difference between the first and second tracks 39 and 40 is that the cup hole 28 is integrally molded to the second track 40. Each track has an upper surface 42 and a lower surface 44 which forms a longitudinal slotted T-shaped connection 46 and a longitudinal narrow conduit 48. The slotted T-shaped connection 46 and the narrow conduit 48 of each track are interconnected by a lockable connector insert 50 and a hollow tube 52 respectively, as shown in FIG. 2. Two longitudinal opposite parallel arcuate gutters 54 and 56 are integrally connected to the elongated tracks 39 and 40 respectively. The length L, and width $W_2$ of the tracks 39 and 40 may be approximately 40 inches by 7 inches respectively.

Once the middle portion 14 is formed, the proximal end 26 of the rear track 18 is connected to one end of the second track 40 by the lockable connector insert 50 such that the cup hole 28 is adjacent to the rear track 18.

FIG. 2 illustrates a partial exploded view of the middle portion 14. This figure shows how the middle portion sections are interconnected to each other. It utilizes the lockable connector insert 50, the hollow tube 52 and a plurality of different elevation blocks 51 (only one is shown for clarity). The elevation blocks 51 are utilized to raise each portion of the elongated putting training track 10 upwardly so that the putting track 10 is at a sloping angle. Each of the elevation blocks 51 is affixed underneath the lockable connector insert 50. One way to affix the block 51 to the insert 50 is by adhesive means 53 such as a double sided tape. The rear and front tracks 18 and 58 are connected respectively to an adjacent one of the two middle tracks 40 and 39 by lockable connector inserts.

Figure 4:
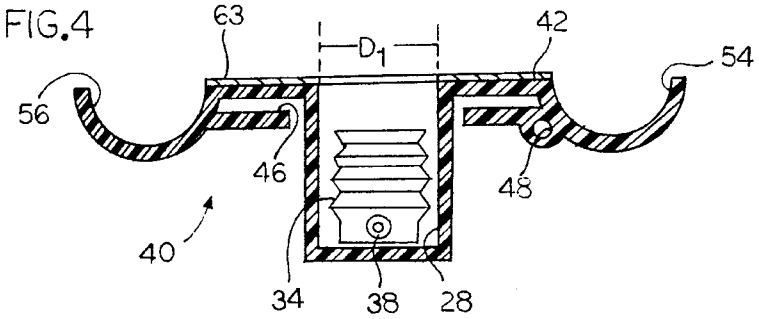
FIG. 4 is a cross-sectional view taken along line 4—4 of FIG. 1.

Referring to FIG. 4, there is shown a cross-sectional view of the cup hole 28 which is located on the upper surface 42 of the second track 40 wherein a bellows shaped blower 34 is provided within the cup hole 28. The bellows shaped blower 34 is utilized for blowing the golf ball out from the cup hole 28. The cup hole 28 also has a side opening (not shown) for allowing a hose (not shown) to be connected to an inlet port 38 of the blower 34. The diameter $D_1$ of the cup hole 28 may be approximately 4¼ inches.

FIG. 5 illustrates an enlarged cross-sectional view of the front portion 16. Referring to FIGS. 1 and 5, the front portion 16 includes a front track 58 with an upper surface 60, a slotted lower surface 62, a proximal end 66, and a distal end 70. The front track 58 has two opposite parallel rails 78 and 80 which are integrally connected to the upper surface 60, and which form a channel 79 therebetween for accommodating a head portion of a conventional putter (shown in FIGS. 8 and 9) and for allowing the golfer to practice putting such that the two opposite rails 78 and 80 will be impacted by the putter when the stroke is not straight. This will serve as a hindering reminder if the stroke is not straight. If the golfer can swing within the rails 78 and 80, and without making contact, he or she has made an acceptable swing. The width $W_1$ of the channel 79 can be increased or decreased by attaching shims 64 on each side of the rails 78 and 80. The shims 64 are affixed to the rails by VELCRO® members 81. By adding more shims 64 on each side of the rails 78 and 80, the width $W_1$ of the channel 79 is decreased and by removing the shims 64, the width $W_1$ of the channel 79 can be increased.

An elongated hose 68 is connected to a pump 72 at one end 82 and the other end is connected to the longitudinal narrow conduit 48 at the first track 39. The pump 72 is utilized for pumping out the golf ball from the cup hole 28 when the golfer putts the golf ball into the cup hole 28. Once the golf ball rolls into the gutters, it will be gravitationally rolled downwardly through the arcuate gutters such that it will automatically return to a location where the golfer stands.

When the front, middle and rear portions 16, 14 and 12 are all connected, they are all symmetrical. The upper surfaces 60 and 42 of the front and middle portions 16 and 14 respectively are covered with an artificial surface 63 so that the elongated putting training track 10 can play similar to a real golf green.

The elongated putting training track 10 can be made from several materials. The manufacturing process which could accommodate the construction of the present invention can be vacuum formed, injection molded, extrusion, thermoform, etc. or other molding process. By way of example, the elongated putting training track 10 can be made of plastic material.

Figure 6:
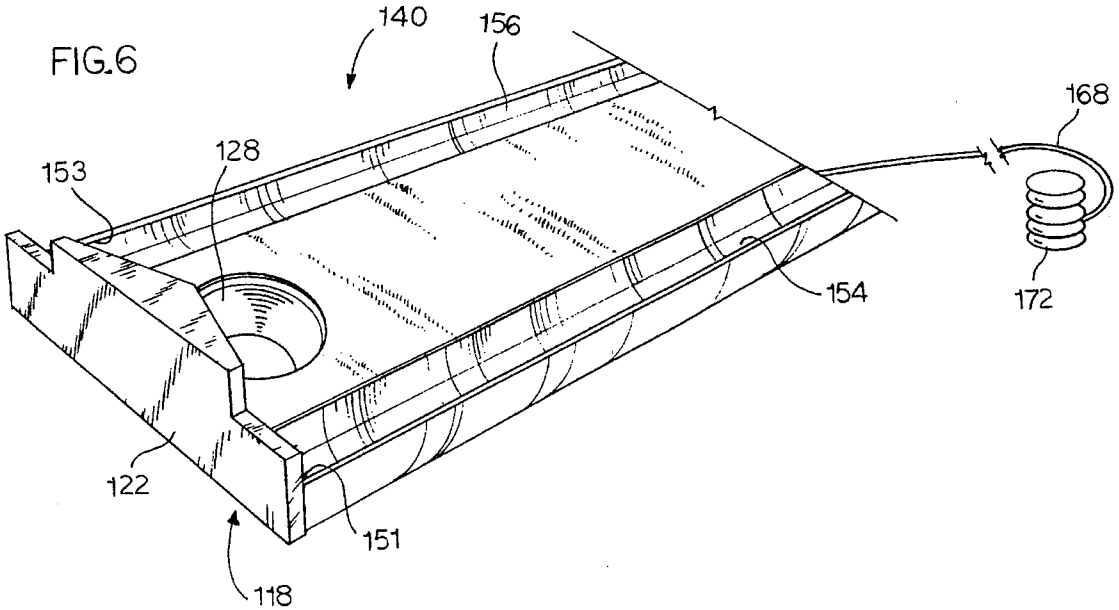
FIG. 6 is a perspective view of an alternative embodiment of the present invention illustrating one of the middle tracks, a triangular rear backboard and a pump which has an elongated hose directly connected to a bellows shaped blower (not shown) within the cup hole.

Referring to FIG. 6, there is shown a perspective view of an alternative embodiment of the present invention which utilizes a rear backboard 118. It assembles the same as previously described above except that the rear backboard 118 is substituted for the rear track 18 shown in FIGS. 1 and 3. All other components are the same as previously described in FIGS. 1, 2, 4 and 5, and the description thereof will not be repeated and only the modified components will be described in detail. In this alternative embodiment, the components are numbered correspondingly with 100 added to each number.

Figure 7:
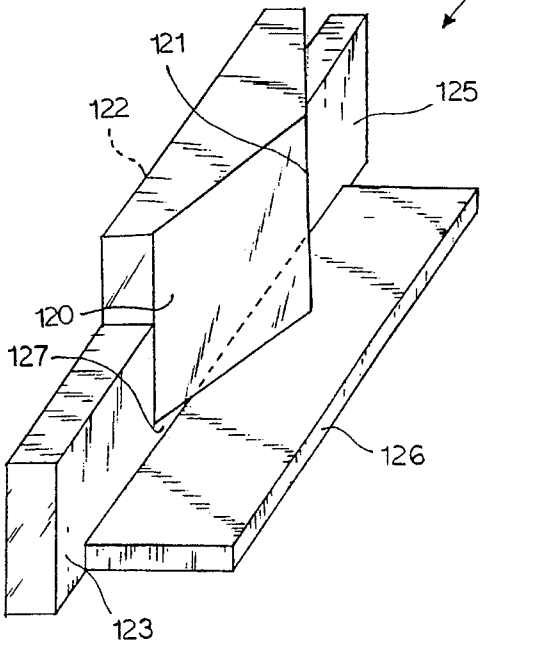
FIG. 7 is an enlarged perspective view of the triangular rear backboard.

Referring to FIGS. 6 and 7, the rear backboard 118 has a front side 120 with a connectable proximal end 126 and a back side 122. The front side 120 has a central triangular shaped surface 121 and two opposite flat surfaces 123 and 125. There is a clearance or gap 127 between the triangular shaped surface 121 and the connectable proximal end 126 for allowing the surface thickness of the track 140 to be between the gap 127 so that the bottom of the triangular shaped surface 121 is abutting against the surface of the track 140. The connectable proximal end 126 is inserted into the slotted lower surface of the second track 140 such that the two opposite flat surfaces 123 and 125 are abutting against the ends 151 and 153 of the gutters 154 and 156 respectively. The triangular shaped surface 121 is directly behind the cup hole 128 of the second track 140 so that if the golf ball misses the cup hole 128, the triangular shaped surface 121 will deflect the golf ball into the gutters 154 and 156, and the golf ball will automatically roll back to the golfer.

In this alternative embodiment, the elongated hose 168 of the pump means 172 is directly connected to the cup hole wherein the bellows shaped blower (not shown) is provided.

It will be appreciated that the present invention is not limited to this type of rear backboard configuration. It is also within the spirit and scope of the present invention to have many different types of configurations incorporated into the present invention.

Figure 8:
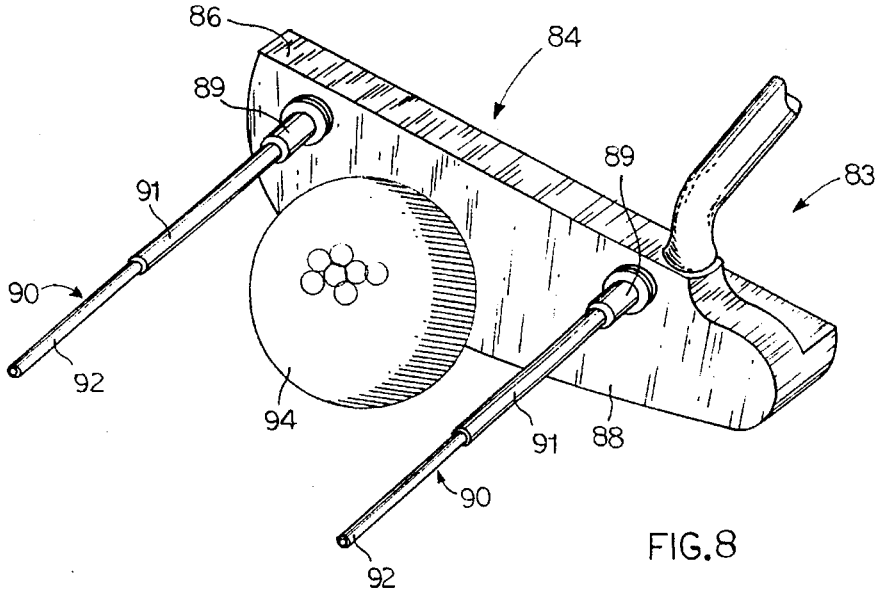
FIG. 8 is an enlarged perspective view of telescoping guide members which are attached to a conventional golf putter.
Figure 9:
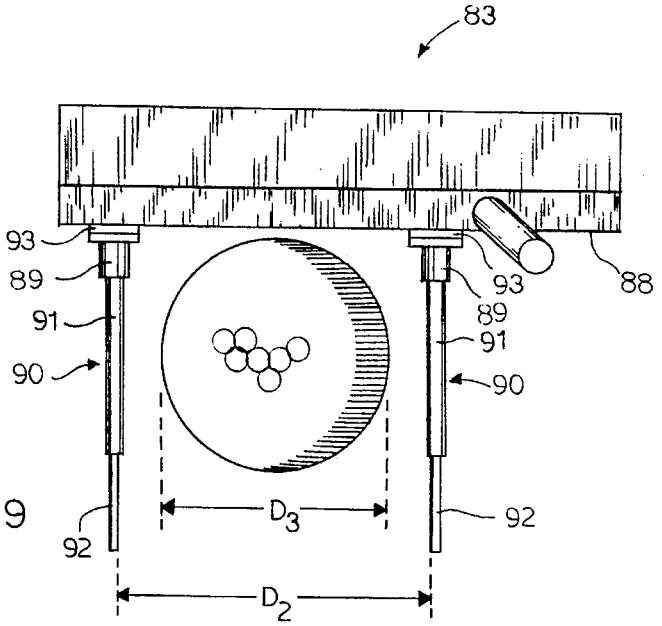
FIG. 9 is an enlarged top plan view of the telescoping guide members and the head portion of the golf putter.

Referring to FIGS. 8 and 9, there is shown the golf putter training device 83. The putter training device 83 is two telescoping elongated guide members 90 which are removably attached to a conventional putter 84. The putter 84 has a head portion 86 with a face plate 88. The two elongated telescoping guide members 90 are removably attachable to the face plate 88 of the head portion 86 by adhesive means such as a double sided tape 93 or other suitable means so that they are removably held in position. The distance $D_2$ between the two elongated guide members 90 is greater than the diameter $D_3$ of a conventional golf ball 94. The guide members 90 extend normally from the face plate 88 to form a boundary between which the golf ball 94 should fit if the ball is properly hit, with a small adjustable space on either side of the golf ball 94.

The putter 84 is used for practice with the two elongated guide members 90 in place, such that the guide members 90 provide guiding spacers for properly hitting the golf ball 94 at the sweet spot portion of the putter. If the golf ball 94 is not between the two guide members 90 when it is stroked, the golf ball 94 will be deflected. When the putter 84 is used for actual golf play, the two guide members 90 can be removed so that the same putter 84 can be used for both practice and actual play. Also, if the face plate 88 of the putter 84 is rotated during the stroke, the guide members 90 will clearly represent to the golfer the rotational error during his or her stroke. Therefore, the guide members 90 will magnify the error during the stroke and make it more clear.

One of the unique features of the putter training device 83 is that the two elongated guide members 90 are repositionable. The distance $D_2$ can be increased or decreased by removing the guide members 90 and affixing them at different locations such as shown in FIGS. 8 and 9, so that the golfer can gradually work himself or herself up to a narrow distance $D_2$. The better the putting stroke, the closer the guide members 90 can be placed to each other for additional muscle memory.

Figure 10:
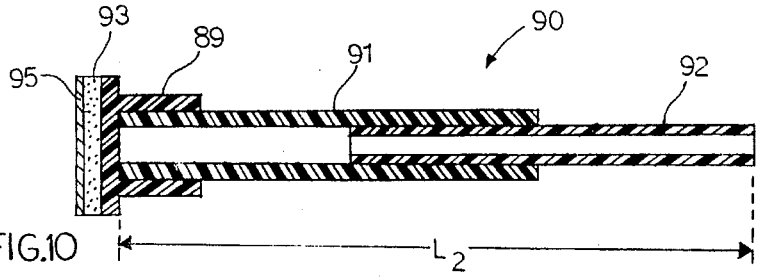
FIG. 10 is an enlarged cross-sectional view of the telescoping guide member.

Referring to FIG. 10, there is shown an enlarged cross-sectional view of the elongated telescoping guide member 90. The telescoping guide member 90 has a sleeve 89, an outer guide 91 and an inner guide 92. The outer guide 91 is affixed within the sleeve 89 such that the inner guide 92 can be extended within the outer guide 91 so the length $L_2$ of the telescoping guide member 90 is increased for increasing the difficulty of hitting the golf ball. One side of the double sided tape 93 is attached to the sleeve 89 and the other side is covered by a removable cover paper 95. The removable cover paper 95 can be removed from the tape 93 when the user is ready to place the telescoping guide member 90 in place.

It will be appreciated that the dimensions described above are merely one illustrative embodiment and can include many other comparable sets of dimensions.

Defined in detail, the present invention is an apparatus for training a golfer in the putting of a golf ball, the apparatus comprising: (a) a longitudinally elongated putting track including a rear portion, a middle portion and a front portion; (b) said rear portion including a rear track with a slanted upper surface, a slotted lower surface, a curved distal end, a proximal end, and an arcuate gutter integrally connected and surrounding the rear track along its circumferences except for the proximal end, the slanted upper surface allowing said golf ball to roll down into the arcuate gutter so that said golf ball can be automatically returned to said golfer; (c) said middle portion including a plurality of tracks, each track having an upper surface, a slotted lower surface, two integrally connected longitudinal opposite parallel arcuate gutters, and a longitudinal narrow conduit located on the lower surface for allowing air to flow therethrough; (d) said front portion including a front track with an upper surface, a slotted lower surface, a proximal end, a distal end, and two opposite parallel rails integrally connected to the upper surface and forming a channel therebetween for allowing said golfer to practice putting by practicing a putting stroke without hitting the two opposite rails; (e) means for adjusting the width of said channel of said front track to increase or decrease the difficulty of the putting stroke; (f) said proximal end of said rear track interconnected with an adjacent one of said plurality of tracks by inserting a lockable connector insert into their said slotted lower surfaces such that the adjacent one of said plurality of tracks is symmetrical to said rear track; (g) said plurality of tracks of said middle portion interconnected by a plurality of lockable connector inserts such that said tracks are symmetrical to each other; (h) said front track interconnected to another adjacent one of said plurality of tracks such that said front track is symmetrical to said other adjacent one of said plurality of tracks; (i) a cup hole located on said upper surface of said track adjacent to said rear track; (j) said narrow conduits of said plurality of tracks of said middle portion interconnected respectively by hollow tubes for allowing air to pass therethrough; (k) a pump having an elongated hose connected to one end of said narrow conduit of said respective one of said plurality of tracks of said middle portion for pumping out said golf ball from said cup hole; (l) a golf putter having a head portion with a face plate; (m) two elongated telescoping guide members repositionably affixed to said face plate of said head portion and extending away from said face plate for allowing said golf ball to fit therebetween, each telescoping guide member having an outer guide and an inner guide such that the inner guide is telescoping from the outer guide and extending away from said face plate to increase the length of the two telescoping guide members for increasing the difficulty of hitting said golf ball; and (n) means for removably affixing said two telescoping guide members to said face plate of said head portion of said golf putter which allows said two telescoping guide members to be repositioned; (p) whereby when said elongated putting track is formed, said golfer can practice putting with said golf ball along said elongated putting track such that when said golf ball is hit into said cup hole, said golfer can press said pump and pump out said golf ball to allow said golf ball to automatically roll back to said golfer on said gutters, and when said golf ball misses said cup hole, said golf ball goes into said gutters and will automatically roll back to said golfer.

Defined broadly, the present invention is an apparatus used in conjunction with a conventional golf putter having a face plate with a head portion for training a golfer in the putting of a golf ball, the apparatus comprising: (a) an elongated putting track including a rear track, at least two middle tracks and a front track; (b) said rear track having an upper surface, a lower surface, a distal end, a proximal end, and a gutter integrally connected and surrounding said rear track along its circumferences except for the proximal end; (c) said at least two middle tracks each having an upper surface, a lower surface, two integrally connected opposite parallel gutters, and a narrow conduit located on the lower surface for allowing air to flow therethrough; (d) said front track having an upper surface, a lower surface, a proximal end, a distal end, and two opposite rails integrally connected to the upper surface and forming a channel therebetween for allowing said golfer to practice putting by practicing a putting stroke without hitting the two opposite rails; (e) means for adjusting the width of said channel of said front track to increase or decrease the difficulty of the putting stroke; (f) means for interconnecting said proximal end of said rear track to an adjacent one of said at least two middle tracks such that the adjacent one of said at least two middle tracks is symmetrical to said rear track; (g) means for interconnecting said proximal end of said front track to another adjacent one of said at least two middle tracks such that said front track is symmetrical to said other adjacent one of said at least two middle tracks; (h) means for interconnecting said narrow conduits and said at least two middle tracks together such that said at least two middle tracks are symmetrical to each other; (i) a cup hole located on said upper surface of said at least two middle tracks adjacent to said rear track; (j) a pump means having a hose connected respectively to said narrow conduits of said at least two middle tracks for pumping out said golf ball from said cup hole; and (k) two telescoping guide members repositionably affixed to said face plate of said head portion and extending away from said face plate for allowing said golf ball to fit therebetween, each telescoping guide member having an outer guide and an inner guide such that the inner guide is telescoping within the outer guide and extending away from said face plate to increase the length of the two telescoping guide members for increasing the difficulty of hitting said golf ball; and (l) means for removably affixing said two telescoping guide members to said face plate of said head portion of said golf putter which allows said two telescoping guide members to be repositioned; (m) whereby when said elongated putting track is formed, said golfer can practice putting with said golf ball along said elongated putting track such that when said golf ball is hit into said cup hole, said golfer can press said pump and pump out said golf ball to allow said golf ball to automatically roll back to said golfer on said gutters, when said golf ball misses said cup hole, said golf gall goes into said gutters and will automatically roll back to said golfer.

Defined more broadly, the present invention is an apparatus used in conjunction with a putter having a head portion for training a golfer in the putting of a golf ball, the apparatus comprising: (a) an elongated putting track including a rear track, at least one middle track and a front track; (b) said rear track having a gutter surrounding along its circumferences except for one end; (c) said at least one middle track having a cup hole and two gutters located between the cup hole; (d) said front track having two rails which form a width variable channel therebetween for allowing said golfer to practice putting by practicing a putting stroke without hitting the two rails; (e) means for connecting said rear track to one end of said at least one middle track and located adjacent to said cup hole, and connecting said front track to the other end of said at least one middle track such that they are all symmetrical; (f) means for removing said golf ball from said cup hole of said at least one middle track; and (g) two guide members repositionably affixed to said head portion of said putter and extending away from said head portion for allowing said golf ball to fit therebetween; (h) whereby when said elongated putting track is formed, said golfer can practice putting with said golf ball along said elongated putting track such that when said golf ball is hit into said cup hole, said means remove said golf ball to allow said golf ball to automatically roll back to said golfer on said gutters, and when said golf ball misses said cup hole, said golf ball goes into said gutters and will automatically roll back to said golfer.

Defined even more broadly, the present invention is an apparatus for training a golfer in the putting of a golf ball, the apparatus comprising: (a) a putting track including a rear track, at least one middle track and a front track; (b) said rear track having a gutter surrounding said rear track; (c) said at least one middle track having a cup hole and two gutters; (d) said front track having two rails forming a width variable channel therebetween for allowing said golfer to practice putting by practicing a putting stroke without hitting the two rails; (e) said rear track connected to one end of said at least one middle track and adjacent to said cup hole, and said front track connected to the other end of said least one middle track; and (f) means for removing said golf ball from said cup hole of said at least one middle track; (g) whereby when said putting track is formed, said golfer can practice putting with said golf ball along said putting track such that when said golf ball is hit into said cup hole, said means remove said golf ball from said cup hole to allow said golf ball to automatically roll back to said golfer on said gutters, and when said golf ball misses said cup hole, said golf ball goes into said gutters and will automatically roll back to said golfer.

Defined alternatively in detail, the present invention is an apparatus used in conjunction with a conventional golf putter having a face plate with a head portion for training a golfer in the putting of a golf ball, the apparatus comprising: (a) an elongated putting track including a rear backboard, at least one middle track and a front track; (b) said rear backboard having a central triangular front surface with two opposite flat surfaces and a proximal end, and a back surface; (c) said at least one middle track having an upper surface, a lower surface, two integrally connected opposite parallel gutters, and a cup hole located on the upper surface; (d) said front track having an upper surface, a lower surface, a proximal end, a distal end, and two opposite rails forming a channel therebetween for allowing said golfer to practice putting by practicing a putting stroke without hitting the two opposite rails; (e) said proximal end of said rear backboard connected to said at least one middle track such that said central triangular front surface is adjacent to said cup hole for deflecting said golf ball into said gutters, and said two opposite flat surfaces of said rear backboard abut against ends of said two gutters of said at least one middle track; (f) means for connecting said proximal end of said front track to said at least one middle track such that they are symmetrical to each other; (g) means for removing said golf ball from said cup hole of said at least one middle track; (h) two telescoping guide members affixed to said face plate of said head portion by repositionable affixing means and extending away from said face plate for allowing said golf ball to fit therebetween, each telescoping guide member having an outer guide and an inner guide such that the inner guide is telescoping within the outer guide and extending away from said face plate to increase the length of the two telescoping guide members for increasing the difficulty of hitting said golf ball; (i) whereby when said elongated putting track is formed, said golfer can practice putting with said golf ball along said elongated putting track such that when said golf ball is hit into said cup hole, said means for removing said golf ball from said cup hole to allow said golf ball to automatically roll back to said golfer on said gutters, when said golf ball misses said cup hole, said rear backboard will deflect said golf gall into said gutters and will automatically roll back to said golfer.

Defined alternatively broadly, the present invention is an apparatus used in conjunction with a putter having a head portion for training a golfer in the putting of a golf ball, the apparatus comprising: (a) an elongated putting track including a rear backboard, at least one middle track and a front track; (b) said rear backboard having a front side; (c) said at least one middle track having a cup hole and two gutters located between the cup hole; (d) said front track having two rails which form a width variable channel therebetween for allowing said golfer to practice putting by practicing a putting stroke without hitting the two rails; (e) said rear backboard connected to one end of said at least one middle track such that said front side is located adjacent to said cup hole for deflecting said golf ball into said gutters, and means for connecting said front track to the other end of said at least one middle track; (f) means for removing said golf ball from said cup hole of said at least one middle track; and (g) two guide members affixed to said head portion of said putter by repositionable affixing means and extending away from said head portion for allowing said golf ball to fit therebetween; (h) whereby when said elongated putting track is formed, said golfer can practice putting with said golf ball along said elongated putting track such that when said golf ball is hit into said cup hole, said means removing said golf ball to allow said golf ball to automatically roll back to said golfer on said gutters, and when said golf ball misses said cup hole, said front side of said rear backboard will deflect said golf ball into said gutters and will automatically roll back to said golfer.

Defined further alternatively in detail, the present invention is a conventional golf putter having a face plate with a head portion for training a golfer in the putting of a golf ball, comprising: (a) two elongated telescoping guide members each having an outer guide and an inner guide, the inner guides telescoping within the outer guides such that the inner guides can be extended forwardly from the outer guides to increase the length of the two telescoping guide members for increasing the difficulty of hitting said golf ball; and (b) means for removably affixing said two elongated telescoping guide members to said face plate of said head portion of said putter which allows said two telescoping guide members to be repositioned; (c) whereby said two elongated telescoping guide members provide guiding spacers for properly hitting said golf ball, and when said golf ball is not between said two elongated telescoping guide members when it is stroked, said golf ball will be deflected, and thereby causing an error on hitting said golf ball.

Defined further alternatively broadly, the present invention is a putter having a head portion for training a golfer in the putting of a golf ball, comprising: (a) two elongated guide members affixed to said head portion of said putter by repositionable affixing means and extending away from said head portion for allowing said golf ball to fit therebetween; (b) whereby said two elongated guide members provide guiding spacers for properly hitting said golf ball, and when said golf ball is not between said two elongated guide members when it is stroked, said golf ball will be deflected, and thereby causing an error on hitting said golf ball.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A conventional golf putter having a face plate with a head portion for training a golfer in the putting of a golf ball, comprising:

a. two elongated telescoping guide members each having an outer guide and an inner guide, the inner guides telescoping within the outer guides such that the inner guides can be extended forwardly from the outer guides to increase the length of the two telescoping guide members for increasing the difficulty of hitting said golf ball; and b. means for removably affixing said two elongated telescoping guide members to said face plate of said head portion of said putter which allows said two telescoping guide members to be repositioned;

c. whereby said two elongated telescoping guide members provide guiding spacers for properly hitting said golf ball, and when said golf ball is not between said two elongated telescoping guide members when it is stroked, said golf ball will be deflected, and thereby causing an error on hitting said golf ball.

2. The golf putter as defined in claim 1 wherein said means for removably affixing said two telescoping guide members to said face plate of said head portion of said putter is double sided adhesive means.

3. The golf putter as defined in claim 1 wherein the distance between said two telescoping guide members can be adjusted to allow for clearance of said golf ball depending on the skill of said golfer.

4. A putter having a head portion for training a golfer in the putting of a golf ball, comprising:

a. two elongated guide members affixed to said head portion of said putter by repositionable affixing means and extending away from said head portion for allowing said golf ball to fit therebetween;

b. whereby said two elongated guide members provide guiding spacers for properly hitting said golf ball, and when said golf ball is not between said two elongated guide members when it is stroked, said golf ball will be deflected, and thereby causing an error on hitting said golf ball.

5. The putter as defined in claim 4 wherein said two guide members each further comprises an outer guide and an inner guide, the inner guides telescoping within the outer guides such that the inner guides can be extended forwardly from the outer guides to increase the length of the two guide members for increasing the difficulty of hitting said golf ball.

6. The putter as defined in claim 4 wherein said two guide members affixed to said face plate of said head portion of said putter by repositionable affixing means is adhesive means.

7. The putter as defined in claim 4 wherein the distance between said two guide members can be adjusted to allow for clearance of said golf ball depending on the skill of said golfer.

* * * * *